United States Patent [19]

Drecker

[11] Patent Number: 4,995,833

[45] Date of Patent: Feb. 26, 1991

[54] ROUND PLUG CASING FOR ELECTRICAL PLUGGING CONTACTS

[75] Inventor: Frank Drecker, Remscheid, Fed. Rep. of Germany

[73] Assignee: Grote & Hartmann GmbH & Co. KG, Wuppertal, Fed. Rep. of Germany

[21] Appl. No.: 466,986

[22] Filed: Jan. 18, 1990

[30] Foreign Application Priority Data

Jan. 26, 1989 [DE] Fed. Rep. of Germany ... 8900889[U]

[51] Int. Cl.[5] ..... H01R 13/40

[52] U.S. Cl. ..... 439/596

[58] Field of Search ..... 439/586, 590, 594, 596, 439/597, 598, 599, 467, 372, 695, 701

[56] References Cited

U.S. PATENT DOCUMENTS

| | | | |
|---|---|---|---|
| 3,250,551 | 5/1966 | Draudt | 439/372 X |
| 3,399,373 | 8/1968 | Maki et al. | 439/596 |
| 4,017,141 | 4/1977 | Bury et al. | 439/596 |
| 4,861,278 | 8/1989 | McBride et al. | 439/596 X |

FOREIGN PATENT DOCUMENTS

| | | |
|---|---|---|
| 7917511 | 12/1982 | Fed. Rep. of Germany . |
| 1559334 | 3/1969 | France . |
| 2528246 | 12/1983 | France . |

*Primary Examiner*—Neil Abrams
*Assistant Examiner*—Khiem Nguyen
*Attorney, Agent, or Firm*—Goodman & Teitelbaum

[57] ABSTRACT

A cylindrical round plug casing of plastic with a casing cylinder wall and a face wall, and chambers extending axially parallel in an interior thereof for an electrical plugging contact, the chambers being formed adjacent on a circular arc peripherally or adjacent to the cylinder wall. The chamber walls are longitudinally divided beginning from the face wall to about half its length, a longitudinal half of the chambers being arranged on the cylinder wall and the other longitudinal half of the chambers being arranged on a hinged cover-type wall part piece which are attached together by hinging strips, where supporting and resting elements prevent undesired opening of the wall part piece from the cylinder wall. The supporting elements are formed from pin-form projections molded externally on the cylinder wall, and strip-form projections formed laterally internally on the hinged cover-type wall part piece. The rest elements include a rest strip formed externally on the outer chamber wall of the last chamber of a chamber series arranged on the circular arc, including several chambers, with an interior-side rest edge, which is gripped behind by a rest edge of a rest hook extending from the wall part piece. On the wall part piece, there is arranged a counter-bearing strip, which in a swinging-to of the wall part piece, grips under a counter-bearing surface of the rest strip, virtually without play.

9 Claims, 2 Drawing Sheets

Figure 3:
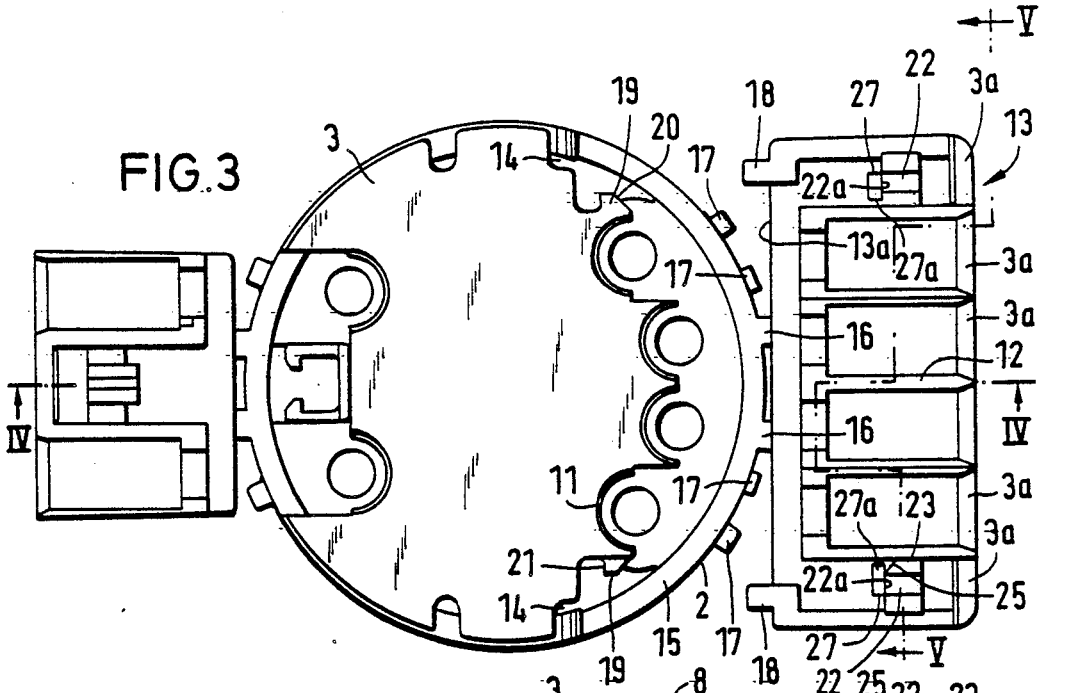

FIG.1
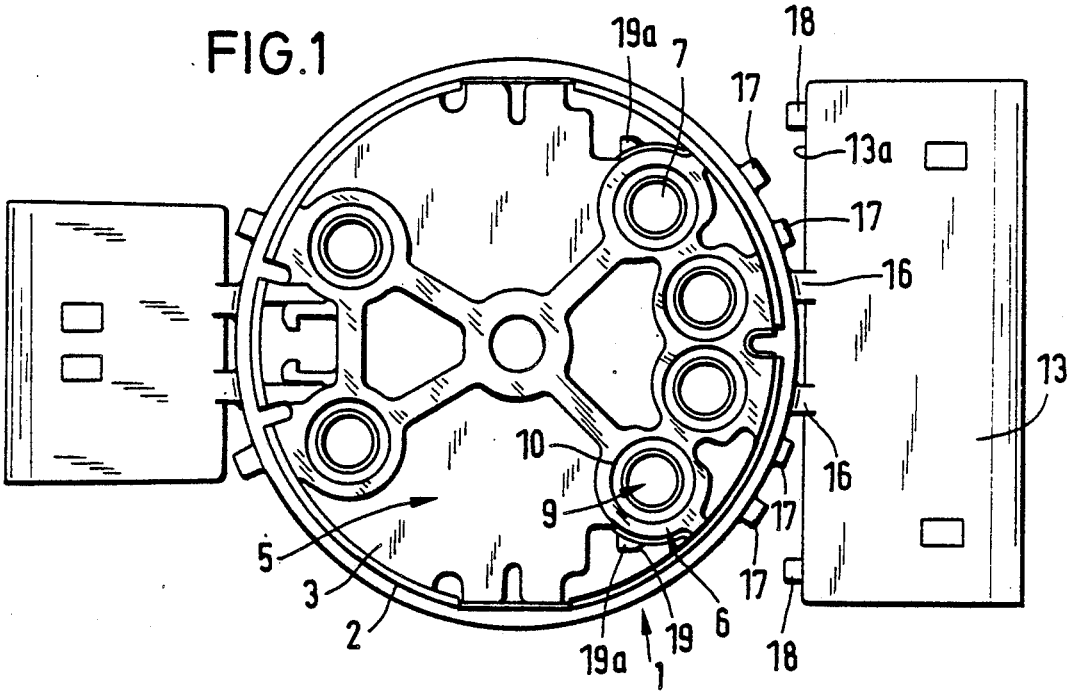
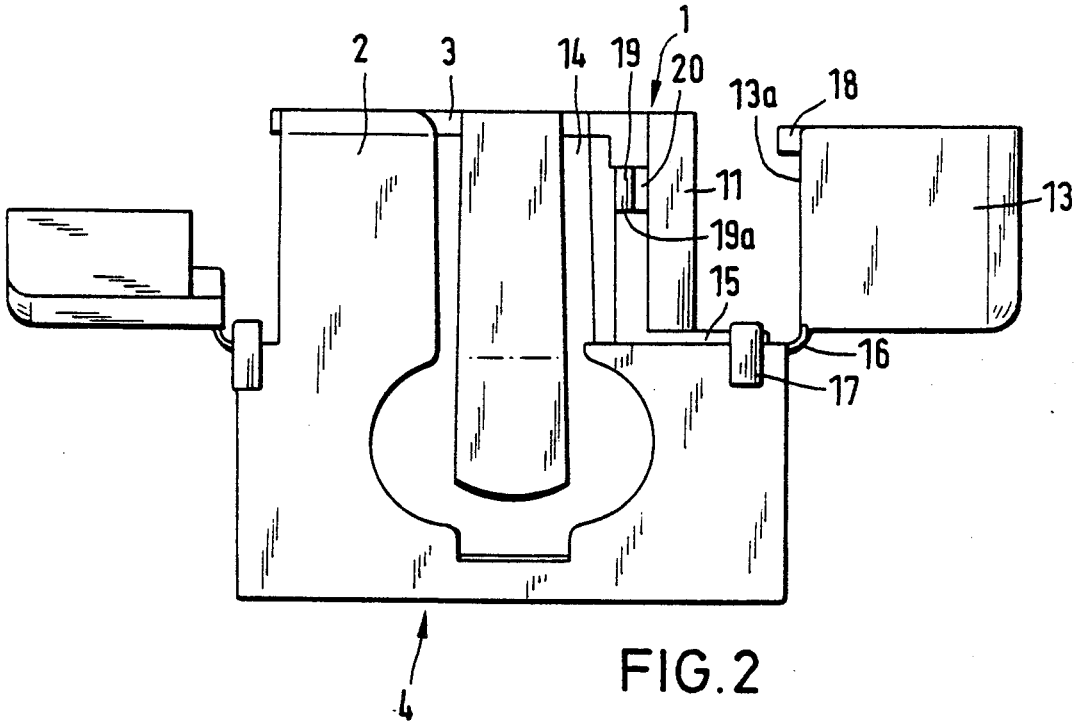
FIG.2

3
14
19
20
17
18
27
22
3a
13
V
22a
13a
27a
16
12
IV
11
21
2
15
25
23

3
8
11
15
16
13
2
9
4
5
27b
22
25
23
12
27
22a
3a 26
3a
13
12
27
24a
23
24
27a
22b
22

ROUND PLUG CASING FOR ELECTRICAL PLUGGING CONTACTS

The invention relates to a cylindrical round plug casing of plastic with chambers extending in axial direction for the bearing of electrical plugging contacts, preferably round plugging contacts.

There is known a round plug casing in which the casing cylinder wall is relatively thin and which has a face wall. In the interior the axially parallel-extending chambers for an electrical plugging contact are each peripherally or adjacent to the cylinder wall. The chambers issue with an opening in the face wall and reach with their oppositely-lying opening to somewhat beyond the longitudinal middle of the round plug casing.

In order to make the chambers accessible, for example for the installing of the plugging contacts, the chamber walls, beginning from the face wall to half their length, are longitudinally divided, one longitudinal half of the chambers being arranged on the cylinder wall, and this zone of the cylinder wall is formed by two lateral separating joints running axially parallel beginning from the face wall and a separating section extending from one to the other separating joint and is attached by externally molded-on hinging strips bridging the separating section, in the manner of a cover to the cylinder wall. Through this arrangement there is an outward-swingable wall part piece, which by its swung-out position makes the chambers accessible for the equipping with electrical plugging contacts. After the equipping, the wall part piece is swung back and borne with supporting and resting means in such a way that an unintended opening is precluded. The supporting means are formed from pin-type projections formed on th fixed cylinder wall and strip-type projections formed laterally inward on the separating section edge, overhanging the separating section, gripping inward behind the fixed cylinder wall. The rest (snap-in) means consist in each case of a rest strip extending in circumferential direction, arranged externally on the chamber wall of in each case the last chamber of a series of chambers presenting several chambers, with a rest edge on internal space side, which is gripped behind by the rest edge of a rest hook extending to the interior space, molded spatially corresponding to the shutter cover-type wall part piece.

It can happen that the hinge strips break. In this case the hinged cover-type wall part piece can be drawn off from the casing in axially parallel direction or is independently detached from the casing, so that the chambers stand open and the electric contact elements installed in the chambers lie exposed.

The problem of the invention is to create a simple device supplementing the known rest means, with which device of the hinging strips there is assured an unlosable support of the wall part piece of hinging cover type.

This problem is solved by the present invention as set forth below, where further developments of the invention are described. With the aid of the drawing the invention is explained in detail by way of example in the following.

Figure 4:
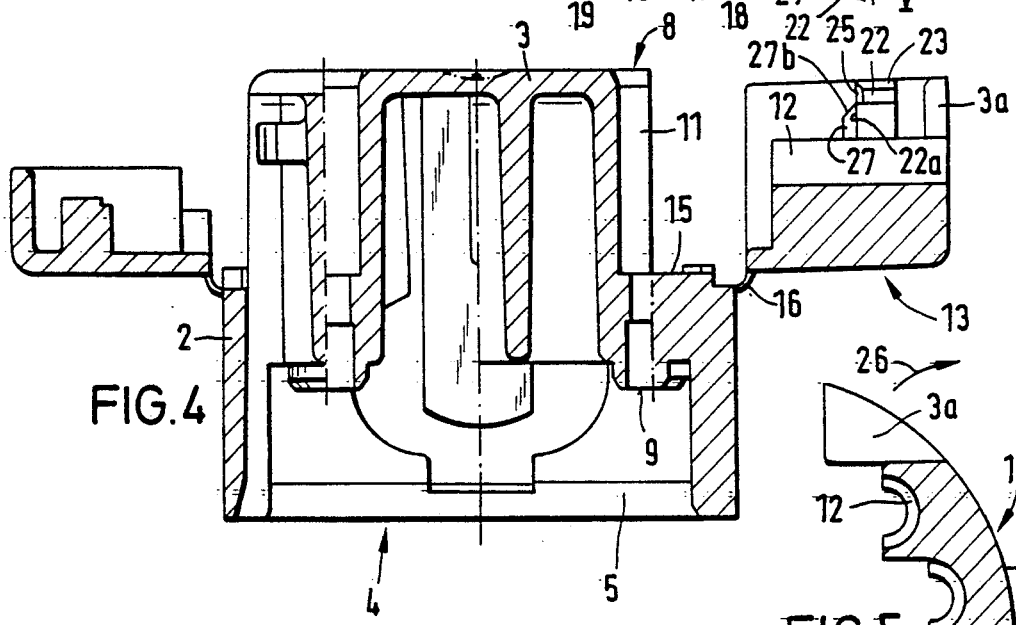
Figure 5:
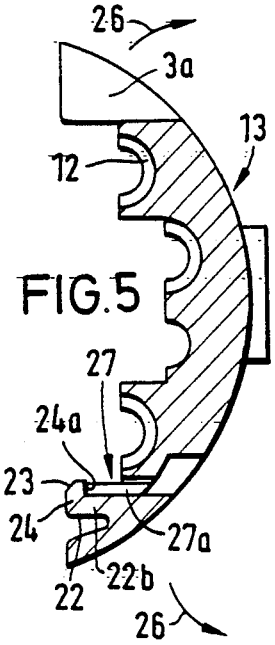

FIG. 1 shows an under-view of the round plug casing with chamfered-on hinged cover;

FIG. 2 a side view of the round plug casing with swung-on hinged cover;

FIG. 3 a plan view of the round plug casing with swung-on hinged cover;

FIG. 4 a longitudinal section through the round plug casing with swung-on hinged cover along the line IV-IV in FIG. 3 with viewing direction in arrow direction;

FIG. 5 a partial cross section through the hinged cover along the line V—V in FIG. 3 with viewing direction in arrow direction.

The round plug casing 1 of plastic, constructed substantially as a hollow cylinder has a cylinder wall 2 and a face wall 3. The side of the round plug casing 1 lying axially opposite the face wall 3 is open (at 4). In the interior 5 of the round plug casing 1 there are formed peripherally in the zone of the cylinder wall 2 in a series on a circular arc four adjacently arranged cylindrical chambers 7 extending axially parallel, which issue with an opening 8 in the face wall 2 and with another opening 9 in the interior a distance below the longitudinal middle of the round plug casing 1.

The chamber walls 10 are longitudinally divided beginning about in the longitudinal middle up to the face wall, there being arranged a wall part 11 in the interior 5 and the other wall part 12 is located on a hinged cover-type wall part piece 13—hereinafter called hinged cover 13.

The hinged cover 13 is formed by two lateral separating joints extending from the face wall 3 to about the longitudinal middle and a separating section 15 present in the longitudinal middle of the round plug casing 1, running from one separating joint 14 to the other separating joint 14 in circumferential direction, in which system there may be present on face side also face wall parts 3a on the hinged cover 13.

The hinged cover 13 is attached to the cylinder wall 2 with two hinging strips 16 formed about at the middle of the circumference on the out side and spaced from one another, bridging the separating section, so that it can be swung outward and thereby the chambers 7 can become accessible from outside. After the swinging back of the hinged cover 13, supporting and resting means are to set the hinged cover 13 firmly on the round plug casing 1.

The supporting means consist—as known per se—of pin-form projections 17 laterally adjacent to the hinging strips 16 on the cylinder wall 2, freely overhanging the separating section 15 and gripping behind the outer surface of the hinged cover 13, as well as of strip-form projections 18 molded laterally in the zone of the separating joints 14 on the inside of the separating section edge 13*a*, gripping over the separating section 15, gripping behind the fixed cylinder wall on the inside.

The rest means are—as known per se—formed, on the one hand, of a rest strip 19 formed on the outer chamber wall of in each case the last outside chamber 7 of a chamber series 6 in the zone of the respective separating joint 14, with a cylindrical wall-side starting bevel 20 and a rest edge 21 more or less turned away from the cylinder wall, as well as, according to the invention, with a bearing surface 19*a* facing away from the face wall 3.

On the other hand, the rest means present a rest hook 22 cooperating with the rest strip 19, which hook 22 is mounted shortly below an outside face wall part 3*a* on the hinged cover 13 to the cylinder wall 2, and extends into the interior 5 and presents a rest lug 24 directed at a right angle to the oppositely-lying side of the hinged cover 13, which lug is provided on the outside with a starting chamfer 23 cooperating with the starting chamfer 20 of the rest strip 19 and is equipped on the inside with a rest edge 24*a* gripping behind the rest edge 21 of the rest strip 19.

Furthermore, on the side of the rest lug 24 facing away from the face wall 3 in the zone of the starting bevel 23 there is provided a chamfering 25 which in the swinging-to of the hinged cover 13 facilitates the sliding past one another of the rest strip 19 and of the rest hook lug 24, in which process the hinged cover 13 is expanded elastically in arrow direction 26 (FIG. 5) and springs back when the rest lugs 24 have snapped behind the rest edges 21.

With the means described, the hinged cover 13 would be locked, snapping in place, and could be drawn off neither radially outward nor axially parallel in the direction of the face wall 3. The latter is prevented by the hinging strips 16. If, however, these hinging strips 16 break, then there is the possibility of drawing off the hinged cover 13 axially parallel in the direction of the face wall 3.

According to the invention this is prevented by the counter-bearing strip 27. This counter-bearing strip 27 is molded on the separating section side lower edge 22*a* of the hook stem 22*b* of the rest hook 22 and springs forward in the zone of the hook stem 22*b* with a strip edge 27*a* in the direction to the opposite side of the hinged cover 13 about as far as the rest lug 24 at the end of the hook stem 22*b*. In the hinged-to state of the cover 13, therefore, the counter-bearing strip edge 27*a* grips under the counter-bearing surface 19a of the rest strip 19 virtually without play, because the spatial forms of the rest means are correspondingly attuned to one another. There, a chamfering at the free end of the counter-bearing strip 27 directed to the rest hook 22 supports the sliding-past of the rest strip 19 on the counter-bearing strip 27 before the effect of the chamfering 25 sets in.

It is possible, therefore, with simple means to snap in place and to lock the hinged cover despite swingable connection of the hinging strips, in such a way that even in the case of breaking of the hinging strips the hinged cover remains unlosably closed. In the closing of the hinged cover especially the chamferings 25 and 27*b*, as well as the starting chamferings 23 and 20, facilitate the threading of the rest lug and the gripping-under of the counter-bearing surfaces 19*a* of the rest strip 19. In the cooperation with the elastic opening up of the hinged cover 13 in arrow direction 26 it is possible to bring the projecting strip 27*a* under the counter-bearing surface 19*a*.

What is claimed is:

1. Cylindrical round plug casing of plastic with a casing cylinder wall and a face wall, and chambers extending axially parallel in an interior thereof for an electrical plugging contact, the chambers are formed adjacent on a circular arc peripherally or adjacent to the cylinder wall, in which the chambers issue with an opening in the face wall and reach with their oppositely lying opening to about over a longitudinal middle of the round plug casing, and in which chamber walls are longitudinally divided beginning from the face wall to about half its length, a longitudinal half of the chambers is arranged on the cylinder wall and this zone of the cylinder wall is formed by two lateral separating joints extending axially parallel to each other beginning from the face wall, and a separating section extending from the one to the other separating joint, and by externally molded-on hinging strips bridging the separating section and attached to the cylinder wall and a hinged cover-type wall part piece, and supporting and resting means for preventing undesired opening of the wall part piece from the cylinder wall, the supporting means are adjacent the hinging strips and are formed of pin-form projections molded externally on the cylinder wall, overhanging the separating section, and strip-form projections formed laterally internally on a separating section edge of the hinged cover-type wall part piece, overhanging the separating section, gripping behind the cylinder wall internally, and the rest means include in each case a rest strip formed externally on an outer chamber wall of in each case a last outside chamber of a chamber series arranged on the circular arc, including several chambers, with an interior-side rest edge, which is gripped behind by a rest edge of a rest hook extending from the wall part piece to the interior, characterized in that on the wall part piece (13), there is arranged a counter-bearing strip (27), which in a swinging-to of the wall part piece (13), grips under a counter-bearing surface (19*a*) of the rest strip (19) arranged on the outer chamber wall of in each case the last outside chamber (7) of the chamber series (6) in a zone of the respective separating joint (14), virtually without play.

2. Round plug casing according to claim 1, characterized in that the rest strip (19) extends in a circumferential direction on the outer chamber wall of in each case the last outside chamber (7) of the chamber series (6) in the zone of the respective separating joint (14).

3. Round plug casing according to claim 2, characterized in that the rest strip (19) includes a cylinder wall-side starting chamfering (20) with the rest edge (21) of the rest strip (19) being turned away from the cylinder wall, in which arrangement a counter-bearing surface (19*a*) is arranged turned-away to the face wall (3).

4. Round plug casing according to claim 3, characterized by the rest hook (22), which in each case is molded shortly underneath a face wall (3) on the wall part piece (13), extends into the interior (5) and includes a rest lug (24) directed at a right angle to an oppositely lying side of the wall part piece (13).

5. Round plug casing according to claim 4, characterized in that the rest lug (24) is equipped on an outside with a starting chamfering (23) cooperating with the starting chamfering (20) of the rest strip (19).

6. Round plug casing according to claim 4, characterized in that the rest lug (24) is equipped on an inside with the rest edge (24*a*) of the rest hook (22) for gripping behind the rest edge (21) of the rest strip (19).

7. Round plug casing according to claim 5, characterized in that on a side of the rest lug (24) away from the face wall (3) in a zone of the starting chamfer (23) there is provided a chamfering (25).

8. Round plug casing according to claim 1, characterized in that the wall part piece (13) is expandable elastically outward in a radial direction.

9. Round plug casing according to claim 4, characterized in that the counter-bearing strip (27) is molded on a side lower edge (22*a*) of a hook stem (22*b*) of the rest hook (22), and in a zone of the hook stem (22*b*), a strip edge (27*a*) of the counter-bearing strip (27) projects forward in a direction toward an oppositely lying side of the wall part piece (13) about as far as the rest lug (24) disposed at an end of the hook stem (22*b*).

* * * * *